US011100882B1

(12) United States Patent
Takeuchi et al.

(10) Patent No.: US 11,100,882 B1
(45) Date of Patent: Aug. 24, 2021

(54) DISPLAY DEVICE

(71) Applicant: SHARP KABUSHIKI KAISHA, Sakai (JP)

(72) Inventors: Yohei Takeuchi, Sakai (JP); Akira Tagawa, Sakai (JP); Yasuaki Iwase, Sakai (JP); Jun Nishimura, Sakai (JP)

(73) Assignee: SHARP KABUSHIKI KAISHA, Osaka (JP)

( * ) Notice: Subject to any disclaimer, the term of this patent is extended or adjusted under 35 U.S.C. 154(b) by 0 days.

(21) Appl. No.: 17/134,926

(22) Filed: Dec. 28, 2020

Related U.S. Application Data

(60) Provisional application No. 62/968,964, filed on Jan. 31, 2020.

(51) Int. Cl.
*G09G 3/36* (2006.01)

(52) U.S. Cl.
CPC ..... *G09G 3/3677* (2013.01); *G09G 3/3688* (2013.01); *G09G 2310/0297* (2013.01); *G09G 2310/08* (2013.01)

(58) Field of Classification Search
CPC ..... G09G 3/3677; G09G 2310/08; G09G 2310/0297; G09G 3/3685–3692
See application file for complete search history.

(56) References Cited

U.S. PATENT DOCUMENTS

| | | | | |
|---|---|---|---|---|
| 8,199,079 | B2 * | 6/2012 | Kim | G09G 3/3233 345/77 |
| 8,319,761 | B2 * | 11/2012 | Lee | G09G 3/20 345/204 |
| 9,076,382 | B2 * | 7/2015 | Choi | G09G 3/3233 |
| 9,190,005 | B2 * | 11/2015 | Watsuda | G09G 3/3685 |
| 2006/0107143 | A1 * | 5/2006 | Kim | G09G 3/3233 714/726 |
| 2006/0262130 | A1 * | 11/2006 | Kim | G09G 3/3291 345/589 |
| 2008/0036704 | A1 * | 2/2008 | Kim | G09G 3/3233 345/76 |
| 2011/0122119 | A1 * | 5/2011 | Bae | G09G 3/3233 345/211 |
| 2018/0012540 | A1 * | 1/2018 | Hosoyachi | G09G 5/10 |
| 2018/0082639 | A1 * | 3/2018 | Shin | G09G 3/3275 |

FOREIGN PATENT DOCUMENTS

JP H05-232508 A 9/1993

* cited by examiner

*Primary Examiner* — David Tung
(74) *Attorney, Agent, or Firm* — ScienBiziP, P.C.

(57) ABSTRACT

In a display device that adopts an SSD scheme, a demultiplexer circuit has provided for each source bus line, a compensating transistor whose first conduction terminal is connected to the source bus line and whose second conducting terminal is maintained in a floating state. In such a configuration, for example, at the same timing as a connection control transistor changes from an on state to an off state due to a change from a high level to a low level of a control signal that is supplied to a control terminal of the connection control transistor, a control signal that is supplied to a control terminal of the compensating transistor changes from the low level to the high level.

7 Claims, 10 Drawing Sheets

DISPLAY DEVICE

BACKGROUND

1. Field

The present disclosure relates to display devices and, in particular, to a display device in which source bus lines (video signal lines) are driven in a time-division manner.

2. Description of the Related Art

In recent years, there has been significant progress for higher resolution and higher definition of images that are displayed on display devices. Higher resolution requires a larger number of source bus lines (video signal lines) through which video signals are transmitted. In this respect, for example, in a common liquid crystal display device, video signals are supplied to source bus lines within a display region by a source driver (video signal line driving circuit) that is mounted in a frame region in the form of an IC chip or the like. For this reason, progress for higher resolution makes it necessary to provide a huge number of pads (pads through which video signals are inputted from the source driver into the display region) 91 in a region in which the source driver is mounted (see FIG. 9). Further, it is also necessary to secure a region 92 for wiring from the pads 91 to the display region. For all of these reasons, progress for higher resolution makes it necessary to make the frame region wider, reducing the degree of freedom of design.

In view of such circumstances, there has been proposed a driving scheme under which "source bus lines (video signal lines) are grouped with two or more source bus lines as one set, one output terminal (pad) of a source driver is assigned to a plurality of source bus lines that constitute a group, and a plurality of source bus lines that constitute a group are driven in a time-division manner during each horizontal scanning period". Such a driving scheme is called "SSD scheme". The term "SSD" is the abbreviation of "Source Shared Driving". Such an SSD scheme is implemented by providing a demultiplexer circuit between the source driver and the source bus lines. Note that signal lines through which the source driver and the demultiplexer circuit are connected to each other are hereinafter referred to as "data output lines". Further, transistors that are provided in the demultiplexer circuit to control a state of electrical connection between the source bus lines and the data output lines is referred to as "connection control transistors". Adopting the SSD scheme, which reduces the number of pads (output terminals) that are needed for the source driver, makes it possible to achieve a narrower frame region.

However, in a case where the SSD scheme is adopted, there may be a reduction in display quality due to unintended reductions (drops) in potential of the source bus lines. This is described. FIG. 10 is a circuit diagram showing a configuration of a demultiplexer circuit 93 that corresponds to one data output line DL in a case where source bus lines are grouped with two source bus lines as one set. In FIG. 10, a source bus line in an odd-numbered column is assigned sign "SLo", and a source bus line in an even-numbered column is assigned sign "SLe". As shown in FIG. 10, the demultiplexer circuit 93 includes a connection control transistor 94*o* that corresponds to the source bus line SLo and a connection control transistor 94*e* that corresponds to the source bus line SLe. In supplying a video signal to the source bus line SLo, the connection control transistor 94*o* is brought into an on state by bringing a control signal SW1 to a high level. In supplying a video signal to the source bus line SLe, the connection control transistor 94*e* is brought into an on state by bringing a control signal SW2 to the high level. For example, the connection control transistor 94*o* is brought into an on state in the first half of each horizontal scanning period, and the connection control transistor 94*e* is brought into an on state in the second half of each horizontal scanning period.

In ending the supply of a video signal to the source bus line SLo, the connection control transistor 94*o* is brought into an off state by changing the control signal SW1 from the high level to a low level. Incidentally, for example, as shown in FIG. 10, a parasitic capacitor 95 is present in the vicinity of the connection control transistor 94*o*. For this reason, by causing the control signal SW1 to fall (i.e. change from the high level to the low level), a reduction in potential of the source bus line SLo is effected, for example, as shown in a portion assigned sign "97" in FIG. 11. Similarly, also when the supply of a video signal to the source bus line SLe is ended, a reduction in potential of the source bus line SLe is effected. Accordingly, a desired voltage is not written to a liquid crystal capacitor (pixel capacitor), so that there is a reduction in display quality.

To address this problem, Japanese Unexamined Patent Application Publication No. 5-232508 discloses a technology directed to a liquid crystal display device provided with a display signal compensating TFT for suppressing a reduction in display quality. The display signal compensating TFT has its drain and source terminals connected to a source bus line and has its gate terminal supplied with an inversion of a selection signal (which is equivalent to the control signal SW1 shown in FIG. 11) (see FIG. 2 of Japanese Unexamined Patent Application Publication No. 5-232508). In ending the supply of a video signal to the source bus line, the inversion of the selection signal changes from a low level to a high level, so that the capacitance of the display signal compensating TFT contributes to a rise (boost) in potential of the source bus line. As a result, the drop and boost in potential of the source bus line get balanced out, so that a desired voltage is written to a liquid crystal capacitor (pixel capacitor). In this way, a reduction in display quality is suppressed.

However, according to the technology disclosed in Japanese Unexamined Patent Application Publication No. 5-232508, a complete three-terminal transistor (i.e. a transistor whose gate terminal, drain terminal, and source terminal are all not in a floating state) is provided as the display signal compensating TFT. Providing such a transistor requires a comparatively large-area region. This results in a reduction in the degree of freedom of design.

Regarding a display device that adopts an SSD scheme, it is desirable to, without reducing the degree of freedom of design, suppress a reduction in display quality attributed to a drop in potential of a source bus line.

SUMMARY

According to an aspect of the disclosure, there is provided a display device including a plurality of video signal lines, a plurality of scanning signal lines that intersect the plurality of video signal lines, a plurality of pixel forming sections disposed in correspondence with intersections of the plurality of video signal lines and the plurality of scanning signal lines, respectively, and a scanning signal line driving circuit that drives the plurality of scanning signal lines, the display device including: a video signal line driving circuit that outputs video signals in a time-division manner during each horizontal scanning period to data output lines corresponding separately to each video signal line group obtained by grouping the plurality of video signal lines with K (where K is an integer of 2 or larger) video signal lines as one set; and a connection switching circuit that changes from connecting a data output line corresponding to a video signal line group to one of K video signal lines constituting the video signal line group to connecting the data output line to another one of the K video signal lines in a time-division manner during each horizontal scanning period, wherein the connection switching circuit includes a connection control transistor and a compensating transistor for each video signal line of interest, the video signal line of interest being an arbitrary video signal line, the connection control transistor including a control terminal, a first conducting terminal connected to a corresponding data output line, and a second conducting terminal connected to the video signal line of interest, the compensating transistor including a control terminal, a first conducting terminal connected to the video signal line of interest, and a second conducting terminal that is maintained in a floating state.

DESCRIPTION OF THE EMBODIMENTS

The following describes embodiments. Note that although one of the drain and source of an n-channel transistor that is higher in potential than the other is called "drain", the after-mentioned transistors include a transistor whose drain and source are interchanged depending on the situation. Accordingly, one of two conducting terminals, namely a drain terminal and a source terminal, of a transistor is hereinafter referred to as "first conducting terminal", and the other one of the two conducting terminals is hereinafter referred to as "second conducting terminal". Note that a gate terminal of a transistor is referred to as "control terminal".

1. First Embodiment

1.1 Overall Configuration and Brief Overview of Operation

Figure 2:
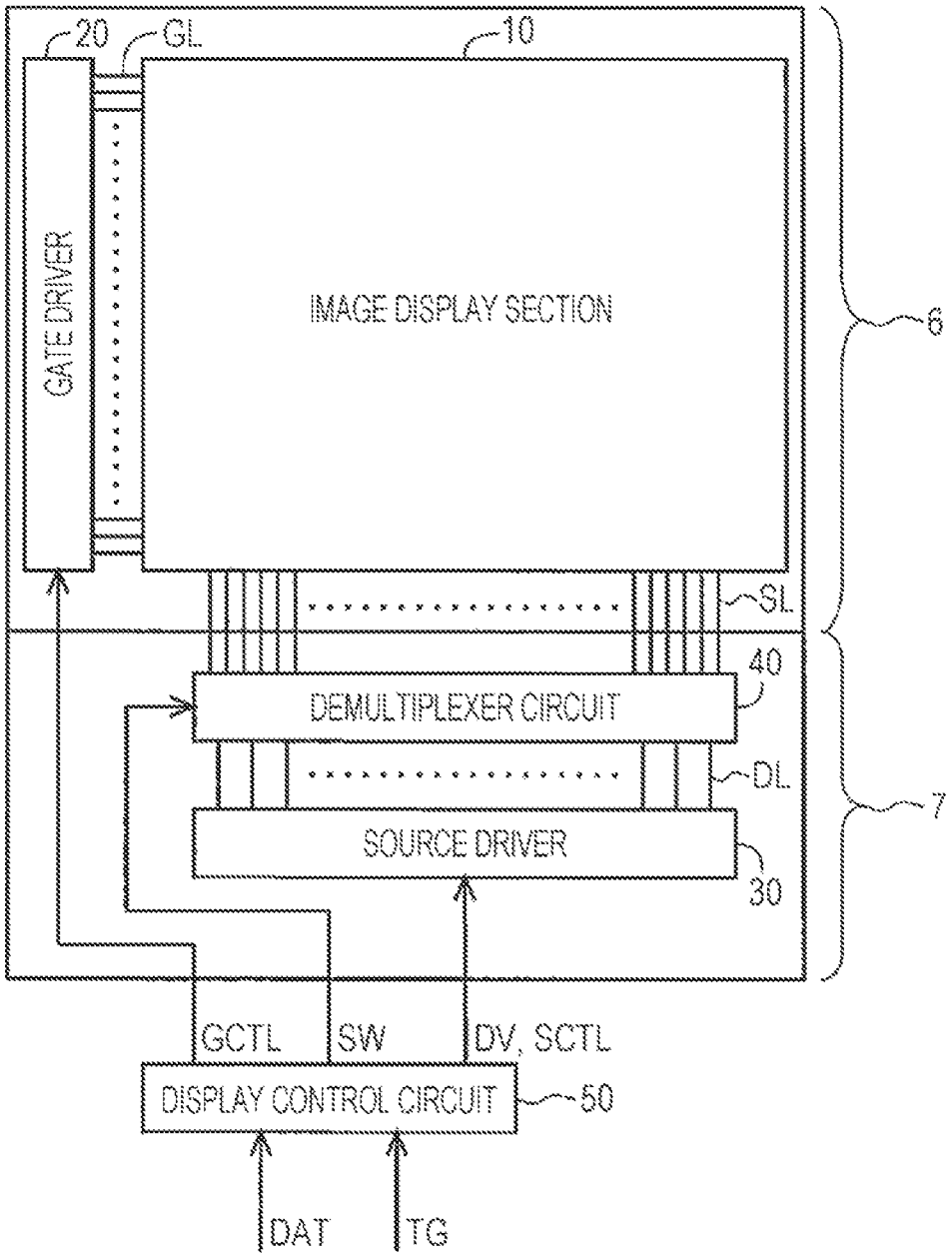
FIG. 2 is a block diagram showing an example of an overall configuration of a liquid crystal display device according to the first embodiment.

FIG. 2 is a block diagram showing an example of an overall configuration of a liquid crystal display device according to a first embodiment (i.e. a liquid crystal display device that adopts an SSD scheme). This liquid crystal display device is constituted by two insulating glass substrates. One of the glass substrates is called "array substrate", and the other one of the glass substrates is called "counter substrate". The array substrate and the counter substrate are bonded together, for example, by a seal material. The array substrate is larger in area than the counter substrate. Accordingly, a region on the array substrate include a frame region 7, which is a region that does not face the counter substrate. Note that a region where the array substrate and the counter substrate completely face each other (i.e. a region assigned sign "6" in FIG. 2) is herein referred to as "display region".

As shown in FIG. 2, this liquid crystal display device functionally includes an image display section 10, a gate driver (scanning signal line driving circuit) 20, a source driver (video signal line driving circuit) 30, a demultiplexer circuit 40, and a display control circuit 50. The image display section 10 and the gate driver 20 are provided in the display region 6. That is, the image display section 10 and the gate driver 20 are monolithically formed on the array substrate. The source driver 30 is provided in the frame region 7, for example, in the form of an IC chip. The display control circuit 50 is provided, for example, on a substrate that is separate from the two glass substrates. Note that a connection switching circuit is implemented by the demultiplexer circuit 40.

The image display section 10 has arranged therein a plurality of gate bus lines (scanning signal lines) GL and a plurality of source bus lines (video signal lines) SL. Further, the image display section 10 is provided with a matrix of a plurality of image forming sections that form pixels. Note that a configuration of the image display section 10 will be described in detail later (see FIG. 3).

The display control circuit 50 receives an image signal DAT and a timing signal group TG, such as a horizontal synchronizing signal and a vertical synchronizing signal, that are transmitted from an outside source and outputs a digital video signal DV, a gate control signal GCTL for controlling operation of the gate driver 20, a source control signal SCTL for controlling operation of the source driver 30, and an SSD control signal SW for controlling operation of the demultiplexer circuit 40. Note that the gate control signal GCTL includes a gate start pulse signal and a gate clock signal, and the source control signal SCTL includes a source start pulse signal, a source lock signal, and a latch strobe signal.

In accordance with a gate control signal GCTL that is transmitted from the display control circuit 50, the gate driver 20 repeats the application of an active scanning signal to each gate bus line GL with one vertical scanning period as a cycle.

In accordance with a digital video signal DV and a source control signal SCTL that are transmitted from the display control circuit 50, the source driver 30 outputs driving video signals in a time-division manner during each horizontal scanning period to data output lines DL corresponding separately to each source bus line group obtained by grouping the plurality of source bus lines SL with two source bus lines SL as one set. At this point in time, digital video signals DV representing voltages to be applied separately to each data output line DL are sequentially retained in the source driver 30 at timings when the source clock signal pulsates. Moreover, at timings when the latch strobe signal pulsates, the digital video signals DV thus retained are converted into analog voltages. The analog voltages thus obtained are concurrently applied as driving video signals to all data output lines DL.

The demultiplexer circuit 40 receives a video signal from the source driver 30 via each data output line DL and, in accordance with an SSD control signal SW that is transmitted from the display control circuit 50, supplies the video signal to either of the two source bus lines SL corresponding to the data output line DL. Note that the demultiplexer circuit 40 will be described in detail later.

In this way, scanning signals are applied to the gate bus lines GL and video signals are applied to the source bus lines SL, whereby an image based on image data DAT transmitted from an outside source is displayed on the image display section 10.

1.2 Configuration of Image Display Section

Figure 3:
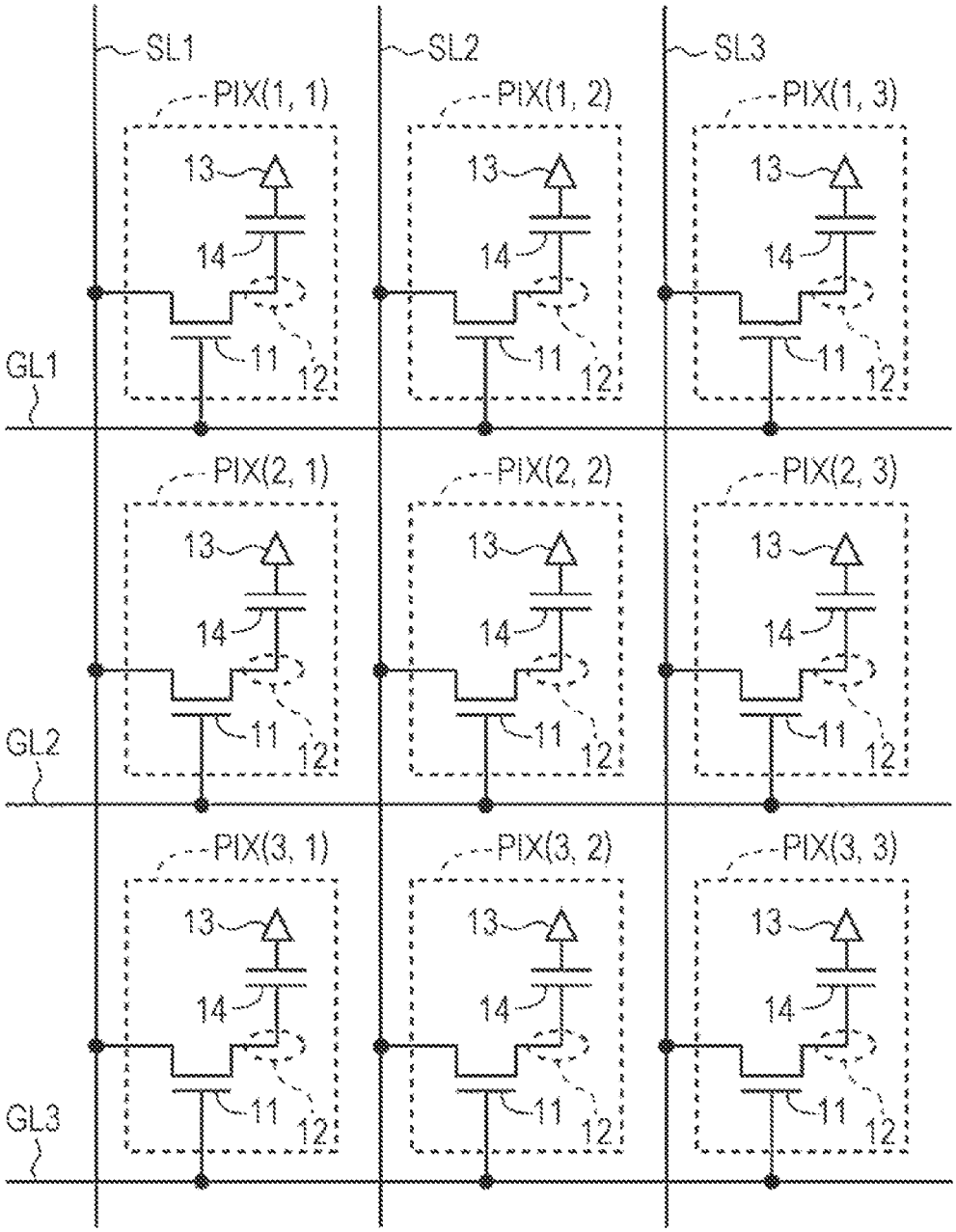
FIG. 3 is a diagram for explaining a configuration of an image display section in the first embodiment.

The configuration of the image display section 10 is described with reference to FIG. 3. FIG. 3 shows a configuration of three rows and three columns within the image display section 10. As can be seen from FIG. 3, pixel forming sections PIX are provided separately in correspondence with an intersection of each gate bus line GL and each source bus line SL. Each pixel forming section PIX includes a pixel transistor 11 whose control terminal is connected to a gate bus line GL passing through a corresponding intersection and whose first conducting terminal is connected to a source bus line SL passing through the intersection, a pixel electrode 12 connected to a second conducting terminal of the image transistor 11, a common electrode 13 commonly provided in a plurality of the pixel forming sections PIX, and a liquid crystal capacitor (pixel capacitor) 14 formed by the pixel electrode 12 and the common electrode 13. An auxiliary capacitor may be provided in parallel with the liquid crystal capacitor 14.

Note that a pixel forming section provided in correspondence with an intersection of a gate bus line in the pth row and a source bus line in the qth column is assigned sign "PIX(p,q)". For example, the pixel forming section assigned sign "PIX(2,1) is a pixel forming section provided in correspondence with an intersection of the gate bus line GL2 in the second row and the source bus line SL1 in the first column.

1.3 Configuration of Demultiplexer Circuit

Figure 1:
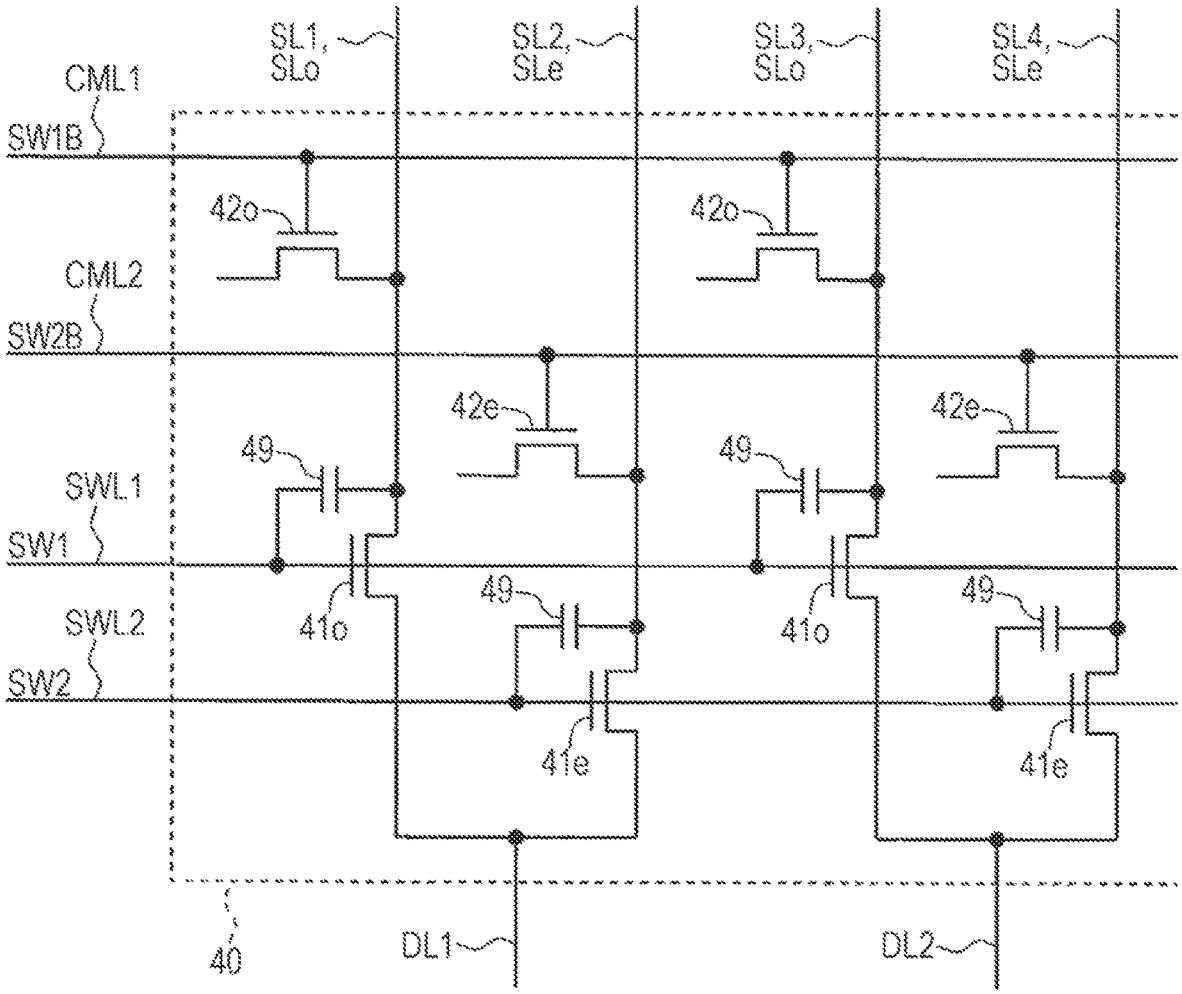
FIG. 1 is a circuit diagram for explaining a configuration of a demultiplexer circuit in a first embodiment.

FIG. 1 is a circuit diagram for explaining a configuration of the demultiplexer circuit 40 in the present embodiment. Note that FIG. 1 shows only constituent elements that correspond to two data output lines DL1 and DL2. Further, FIG. 1 adds sign "SLo" to source bus lines in odd-numbered columns and adds sign "SLe" to source bus lines in even-numbered columns.

As mentioned above, in the present embodiment, the plurality of source bus lines SL are grouped with two source bus lines SL as one set. This is achieved by associating one data output line DL with two source bus lines SL as shown in FIG. 1. Thus, in the present embodiment, two source bus lines SL serve as one driving unit in terms of driving the source bus lines SL.

The demultiplexer circuit 40 includes, in addition to the aforementioned connection control transistors, transistors (hereinafter referred to as "compensating transistors") for compensating for unintended drops (reductions) in potential of the source bus lines SL. In particular, as shown in FIG. 1, the demultiplexer circuit 40 includes connection control transistors 410 that correspond to the source bus lines SLo in the odd-numbered columns, connection control transistors 41*e* that correspond to the source bus lines SLe in the even-numbered columns, compensating transistors 42*o* that correspond to the source bus lines SLo in the odd-numbered columns, and compensating transistors 42*e* that correspond to the source bus lines SLe in the even-numbered columns. Thus, the compensating transistors are provided separately for each source bus line. Further, as shown in FIG. 1, the demultiplexer circuit 40 has arranged therein a connection control line SWL1 through which to transmit a control signal SW1 that is supplied to the control terminal of the connection control transistor 41*o*, a connection control line SWL2 through which to transmit a control signal SW2 that is supplied to the control terminal of the connection control transistor 41*e*, a compensation control line CML1 through which to transmit a control signal SW1B that is supplied to the control terminal of the compensating transistor 42*o*, and a compensation control line CML2 through which to transmit a control signal SW2B that is supplied to the control terminal of the compensating transistor 42*e*. Note that parasitic capacitors 49 are present in the vicinity of the connection control transistors 410 and the connection control transistors 41*e*.

The connection transistors 41*o*, the connection control transistors 41*e*, the compensating transistors 42*o*, and the compensating transistors 42*e* are n-channel thin-film transistors. Each of the connection control transistors 410 has its control terminal connected to the connection control line SWL1, has its first conducting terminal connected to a data output line DL, and has its second conducting terminal connected to a source bus line SLo. Each of the connection control transistors 41*e* has its control terminal connected to the connection control line SWL2, has its first conducting terminal connected to a data output line DL, and has its second conducting terminal connected to a source bus line SLe. Each of the compensating transistors 42*o* has its control terminal connected to the compensation control line CML1, has its first conducting terminal connected to a source bus line SLo, and has its second conducting terminal maintained in a floating state. Each of the compensating transistors 42*e* has its control terminal connected to the compensation control line CML2, has its first conducting terminal connected to a source bus line SLe, and has its second conducting terminal maintained in a floating state.

The demultiplexer circuit 40 receives the control signal SW1, the control signal SW2, the control signal SW1B, and the control signal SW2B as SSD control signals SW. The control signal SW1B is an inversion of the control signal SW1. The control signal SW2B is an inversion of the control signal SW2.

In such a configuration, when video signals are applied to the source bus lines SLo in the odd-numbered columns, the display control circuit 50 brings the control signal SW1 to a high level (first level) and brings the control signal SW2 to a low level (second level). This brings the connection control transistors 410 into an on state and brings the connection control transistors 41*e* into an off state, so that the data output lines DL are electrically connected to the source bus lines SLo in the odd-numbered columns. Meanwhile, when video signals are applied to the source bus lines SLe in the even-numbered columns, the display control circuit 50 brings the control signal SW1 to the low level and brings the control signal SW2 to the high level. This brings the connection control transistors 410 into an off state and brings the connection control transistors 41*e* into an on state, so that the data output lines DL are electrically connected to the source bus lines SLe in the even-numbered columns. In this way, the demultiplexer circuit 40 in the present embodiment changes from connecting a data output line DL corresponding to a source bus line group to one of two source bus lines SL constituting the source bus line group to connecting the data output line DL to the other one of the two source bus lines SL in a time-division manner during each horizontal scanning period. Specifically, in the first half of each horizontal scanning period, the data output line DL is connected to the source bus line SLo in the odd-numbered column, whereby a video signal is applied to the source bus line SLo in the odd-numbered column, and in the second half of each horizontal scanning period, the data output line DL is connected to the source bus line SLe in the even-numbered column, whereby a video signal is applied to the source bus line SLe in the even-numbered column.

1.4 Driving Method

Figure 4:
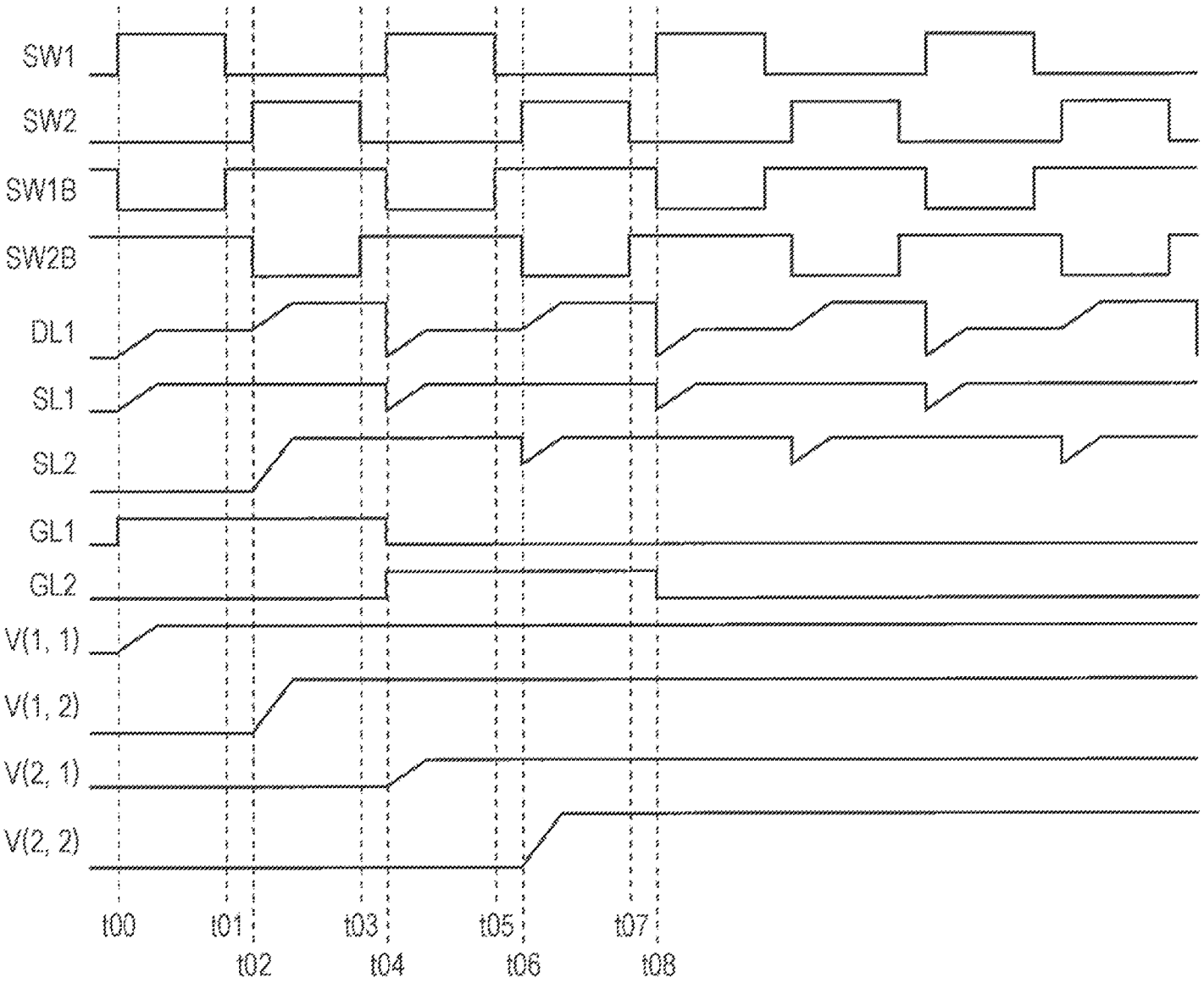
FIG. 4 is a timing chart for explaining a driving method in the first embodiment.

Next, a driving method in the present embodiment is described with reference to a timing chart shown in FIG. 4. Attention is paid here to an operation associated with writing (charging of the liquid crystal capacitors 14 on the basis of video signals) to four pixel forming sections PIX(1,1), PIX(1,2), PIX(2,1), and PIX(2,2) (see FIG. 3). That is, attention is paid exclusively to the source bus line SL1 and the source bus line SL2 out of the source bus lines, and attention is paid exclusively to the data output line DL1 out of the data output lines. Note that a waveform indicated by sign "V(p,q)" in FIG. 4 represents the charging potential of the liquid crystal capacitor (pixel capacitor) 14 in the pixel forming section PIX(p,q) (the same applies to FIGS. 6 and 8). For example, the waveform indicated by sign "V(2,1)" represents the charging potential of the liquid crystal capacitor 14 in the pixel forming section PIX(2,1).

Immediately before a time point t00, the control signal SW1 and the control signal SW2 are at the low level. Accordingly, the connection control transistor 410 and the connection control transistor 41*e* are in an off state. Note that the control signal SW1B and the control signal SW2B are at the high level.

At the time point t00, the control signal SW1 changes from the low level to the high level. This brings the connection control transistor 410 into an on state, so that the data output line DL1 and the source bus line SL1 are electrically connected to each other. As a result, a video signal is applied to the source bus line SL1. That is, the potential of the source bus line SL1 changes according to a change in potential of the data output line DL1 (i.e. potential of a video signal outputted from the source driver 30). Further, at the time point t00, the potential of the gate bus line GL1 changes from the low level to the high level. This brings the pixel transistor 11 of each pixel forming section PIX in the first row into an on state. Thus, a video signal is applied to the pixel electrode 12 within the pixel forming section PIX(1,1), and the liquid crystal capacitor 14 within the pixel forming section PIX(1,1) is charged on the basis of the potential of the video signal at this point in time. Note that while the control signal SW1B changes from the high level to the low level at the time point t00, the connection control transistor 410 is maintained in an on state throughout a period from the time point t00 to a time point t01. Accordingly, the change in level of the control signal SW1B at the time point t00 does not affect the charging potential V(1,1) of the liquid crystal capacitor 14 in the pixel forming section PIX(1,1).

At the time point t01, the control signal SW1 changes from the high level to the low level. This brings the connection control transistor 410 into an off state. At this point in time, a drop in potential of the source bus line SL1 occurs due to the presence of the parasitic capacitor 49 in the vicinity of the connection control transistor 41*o*. However, at the time point t01, the control signal SW1B changes from the low level to the high level. At this point in time, the capacitance of the compensating transistor 42*o* contributes to a boost in potential of the source bus line SL1. This causes the drop and boost in potential of the source bus line SL1 to get balanced out. Accordingly, there is almost no change in potential of the source bus line SL1 before or after the time point t01. That is, even such a change of the control signal SW1 from the high level to the low level at the time point t01 does not affect the charging potential V(1,1) of the liquid crystal capacitor 14 in the pixel forming section PIX(1,1).

At a time point t02, the control signal SW2 changes from the low level to the high level. This brings the connection control transistor 41*e* into an on state, so that the data output line DL1 and the source bus line SL2 are electrically connected to each other. As a result, a video signal is applied to the source bus line SL2. That is, the potential of the source bus line SL2 changes according to a change in potential of the data output line DL1 (i.e. potential of a video signal outputted from the source driver 30). The potential of the gate bus line GL1 is maintained at the high level. Accordingly, in each pixel forming section PIX in the first row, the pixel transistor 11 is maintained in an on state. Thus, a video signal is applied to the pixel electrode 12 within the pixel forming section PIX(1,2), and the liquid crystal capacitor 14 within the pixel forming section PIX(1,2) is charged on the basis of the potential of the video signal at this point in time. Note that while the control signal SW2B changes from the high level to the low level at the time point t02, the connection control transistor 41*e* is maintained in an on state throughout a period from the time point t02 to a time point t03. Accordingly, the change in level of the control signal SW2B at the time point t02 does not affect the charging potential V(1,2) of the liquid crystal capacitor 14 in the pixel forming section PIX(1,2).

At the time point t03, the control signal SW2 changes from the high level to the low level. This brings the connection control transistor 41*e* into an off state. At this point in time, a drop in potential of the source bus line SL2 occurs due to the presence of the parasitic capacitance 49 in the vicinity of the connection control transistor 41*e*. However, at the time point t03, the control signal SW2B changes from the low level to the high level. At this point in time, the capacitance of the compensating transistor 42*e* contributes to a boost in potential of the source bus line SL2. This causes the drop and boost in potential of the source bus line SL2 to get balanced out. Accordingly, there is almost no change in potential of the source bus line SL2 before or after the time point t03. That is, even such a change of the control signal SW2 from the high level to the low level at the time point t03 does not affect the charging potential V(1,2) of the liquid crystal capacitor 14 in the pixel forming section PIX(1,2).

During a period from a time point t04 to a time point t08, the potential of the gate bus line GL2 is maintained at the high level. Accordingly, during the period from the time point t04 to the time point t08, writing to the pixel forming sections in the second row is performed. In this respect, during a period from the time point t04 to a time point t05, the data output line DL1 and the source bus line SL1 are electrically connected to each other, as in the case of the period from the time point t00 to the time point t01. As a result, during the period from the time point t04 to the time point t05, the charging potential V(2,1) of the liquid crystal capacitor 14 in the pixel forming section PIX(2,1) changes on the basis of the potential of a video signal. Further, during a period from a time point t06 to a time point t07, the data output line DL1 and the source bus line SL2 are electrically connected to each other, as in the case of a period from the time point t02 to the time point t03. As a result, during the period from the time point t06 to the time point t07, the charging potential V(2,2) of the liquid crystal capacitor 14 in the pixel forming section PIX(2,2) changes on the basis of the potential of a video signal. As in the case of a period from the time point t01 to the time point t04, even a change of the control signal SW1 from the high level to the low level at the time point t05 does not affect the charging potential V(2,1) of the liquid crystal capacitor 14 in the pixel forming section PIX(2,1), and even a change of the control signal SW2 from the high level to the low level at the time point t07 does not affect the charging potential V(2,2) of the liquid crystal capacitor 14 in the pixel forming section PIX(2,2).

As can be seen from FIG. 4, at the point of time where the control signal SW1 changes from the high level to the low level, the control signal SW1B changes from the low level to the high level, and at the point of time where the control signal SW2 changes from the high level to the low level, the control signal SW2B changes from the low level to the high level. Thus, in the present embodiment, at the same timing as a connection control transistor changes from an on state to an off state due to a change from the high level to the low level of a control signal that is supplied to the control terminal of the connection control transistor, a control signal that is supplied to the control terminal of a compensating transistor corresponding to the connection control transistor changes from the low level to the high level. Further, as mentioned above, the control signal SW1B is an inversion of the control signal SW1, and the control signal SW2B is an inversion of the control signal SW2. That is, in the present embodiment, when a control signal that is supplied to the control terminal of a connection control transistor is at the high level, a control signal that is supplied to the control terminal of a compensating transistor corresponding to the connection control transistor is at the low level, and when a control signal that is supplied to the control terminal of a connection control transistor is at the low level, a control signal that is supplied to the control terminal of a compensating transistor corresponding to the connection control transistor is at the high level.

1.5 Effects

Figure 5:
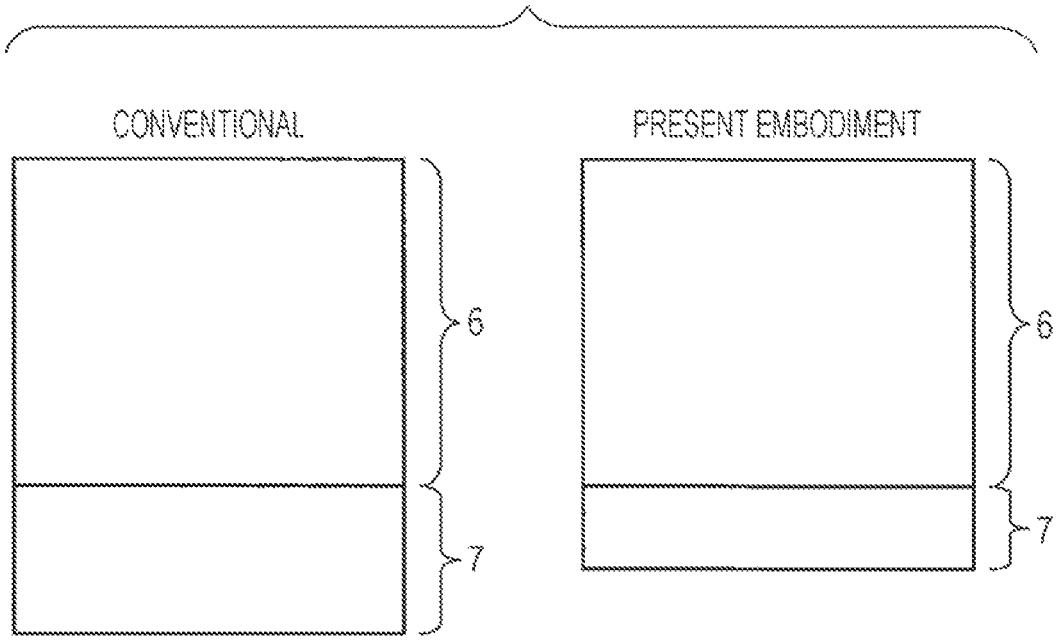
FIG. 5 is a diagram for explaining effects of the first embodiment.

According to the present embodiment, the demultiplexer circuit 40 has provided for each source bus line SL a compensating transistor whose first conducting terminal is connected to the source bus line SL and whose second conducting terminal is maintained in a floating state. Moreover, regarding each source bus line SL, at the same timing as a connection control transistor changes from an on state to an off state due to a change from the high level to the low level of a control signal that is supplied to the control terminal of the connection control transistor, a control signal that is supplied to the control terminal of a compensating transistor corresponding to the connection control transistor changes from the low level to the high level. This causes the drop and boost in potential of the source bus line SL to get balanced out when the connection control transistor changes from an on state to an off state. This causes a desired voltage to be written to the liquid crystal capacitor 14 in each pixel forming section PIX. That is, a reduction in display quality is suppressed. Incidentally, in a case where a complete three-terminal transistor (i.e. a transistor whose control terminal, first conducting terminal, and second conducting terminal are all not in a floating state) is provided as a compensating transistor as in the case of the technology disclosed in Japanese Unexamined Patent Application Publication No. 5-232508, there is a reduction in the degree of freedom of design, as a contact hole and the like require a comparatively large-area region. On the other hand, in the present embodiment, since a compensating transistor has its second conducting terminal in a floating state, the area of a region required to provide the compensating transistor is comparatively small. This makes possible to, as shown in FIG. 5, make the frame region 7 narrower than it has conventionally been (in the configuration disclosed in Japanese Unexamined Patent Application Publication No. 5-232508). Thus, according to the present embodiment, regarding a liquid crystal display device that adopts an SSD scheme, a reduction in display quality attributed to a drop in potential of a source bus line SL is suppressed without a reduction in the degree of freedom of design.

2. Second Embodiment 2.1 Configuration

An overall configuration of a liquid crystal display device, a configuration of an image display section 10, and a configuration of a demultiplexer circuit 40 are identical to those of the first embodiment (see FIGS. 1 to 3). Accordingly, a description thereof is omitted.

2.2 Driving Method

A driving method in the present embodiment is described with reference to a timing chart shown in FIG. 6. An operation during a period prior to a time point t12 is identical to the operation during a period prior to the time point t02 in the first embodiment (see FIG. 4).

After the control signal SW2 has changed from the low level to the high level at the time point t12, the control signal SW2 is maintained at the high level until a time point t14. With attention paid to the potential of the gate bus line GL1, the potential changes from the high level to the low level at a time pint t13. That is, a horizontal scanning period during which to perform writing to the pixel forming sections PIX in the first row ends at the time point t13. Note that during a period from a time point t10 to a time point t11, the charging potential V(1,1) of the liquid crystal capacitor 14 in the pixel forming section PIX(1,1) changes on the basis of the potential of a video signal, and during a period from the time point t12 to the time point t13, the charging potential V(1,2) of the liquid crystal capacitor 14 in the pixel forming section PIX(1,2) changes on the basis of the potential of a video signal.

At the time point t13, the potential of the gate bus line GL2 changes from the low level to the high level. This brings the pixel transistor 11 of each pixel forming section PIX in the second row into an on state. Before and after the time point t13, the control signal SW2 is maintained at the high level, and the control signal SW1 is maintained at the low level. Thus, at the time point t13, a video signal is applied to the pixel electrode 12 within the pixel forming section PIX(2,2), and the liquid crystal capacitor 14 within the pixel forming section PIX(2,2) is charged on the basis of the potential of the video signal at this point in time.

At the time point t14, the control signal SW2 changes from the high level to the low level. This brings the connection control transistor 41*e* into an off state. At this point in time, a drop in potential of the source bus line SL2 occurs due to the presence of the parasitic capacitor 49 in the vicinity of the connection control transistor 41*e*. However, at the time point t14, the control signal SW2B changes from the low level to the high level. At this point in time, the capacitance of the compensating transistor 42*e* contributes to a boost in potential of the source bus line SL2. This causes the drop and boost in potential of the source bus line SL2 to get balanced out. Accordingly, there is almost no change in potential of the source bus line SL2 before or after the time point t14. That is, even such a change of the control signal SW2 from the high level to the low level at the time point t14 does not affect the charging potential V(2,2) of the liquid crystal capacitor 14 in the pixel forming section PIX(2,2).

At a time point t15, the control signal SW1 changes from the low level to the high level. This brings the connection control transistor 410 into an on state, so that the data output line DL1 and the source bus line SL1 are electrically connected to each other. Further, before and after the time point t15, the potential of the gate bus line GL2 is maintained at the high level. Thus, at the time point t15, a video signal is applied to the pixel electrode 12 within the pixel forming section PIX(2,1), and the liquid crystal capacitor 14 within the pixel forming section PIX(2,1) is charged on the basis of the potential of the video signal at this point in time.

At a time point t16, the potential of the gate bus line GL2 changes from the high level to the low level. That is, a horizontal scanning period during which to perform writing to the pixel forming sections PIX in the second row ends at the time point t16.

Figure 6:
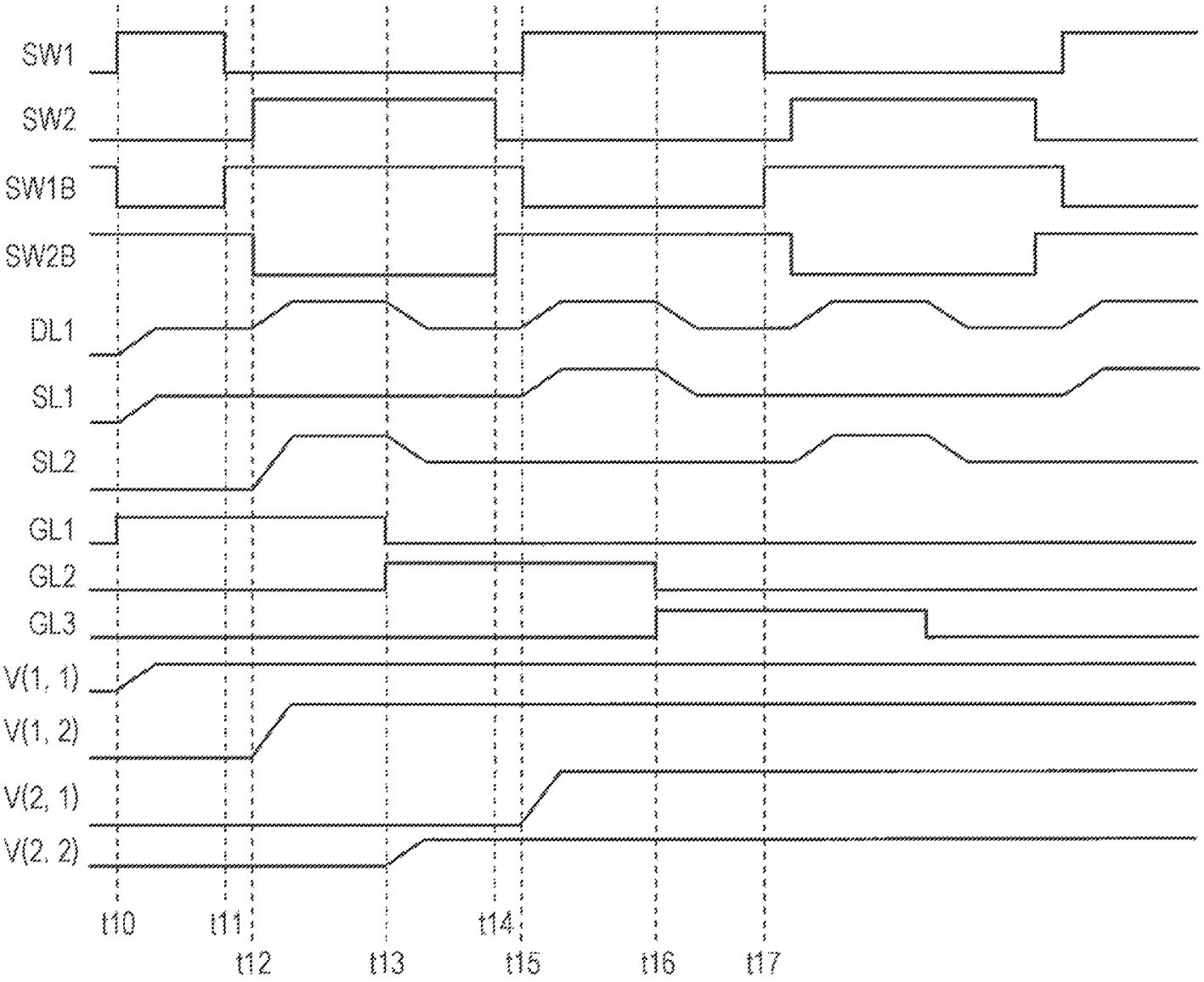
FIG. 6 is a timing chart for explaining a driving method in a second embodiment.

In the present embodiment, too, as can be seen from FIG. 6, at the point of time where the control signal SW1 changes from the high level to the low level, the control signal SW1B changes from the low level to the high level, and at the point of time where the control signal SW2 changes from the high level to the low level, the control signal SW2B changes from the low level to the high level. Accordingly, there is almost no change in potential of a source bus line SL before or after a point of time where a connection control transistor changes from an on state to an off state.

Further, in the present embodiment, over a period from the second half of an odd-numbered horizontal scanning period to the first half of an even-numbered horizontal scanning period (e.g. over a period from the time point t12 to the time point t14), the connection control transistor 41*e* is maintained in an on state by the control signal SW2 being maintained at the high level, and over a period from the second half of an even-numbered horizontal scanning period to the first half of an odd-numbered horizontal scanning period (e.g. over a period from the time point t15 to the time point t17), the connection control transistor 410 is maintained in an on state by the control signal SW1 being maintained at the high level. Since such a driving method is adopted, the SSD control signals SW (namely, the control signal SW1, the control signal SW2, the control signal SW1B, and the control signal SW2B) are lower in frequency than they are in the first embodiment.

2.3 Effects

According to the present embodiment, as in the case of the first embodiment, regarding a liquid crystal display device that adopts an SSD scheme, a reduction in display quality attributed to a drop in potential of a source bus line SL is suppressed without a reduction in the degree of freedom of design. Further, since the SSD control signals SW are lower in frequency than they are in the first embodiment, an effect of reducing power consumption can be brought about.

3. Third Embodiment 3.1 Configuration

An overall configuration of a liquid crystal display device and a configuration of an image display section 10 are identical to those of the first embodiment (see FIGS. 2 and 3). Accordingly, a description thereof is omitted.

Figure 7:
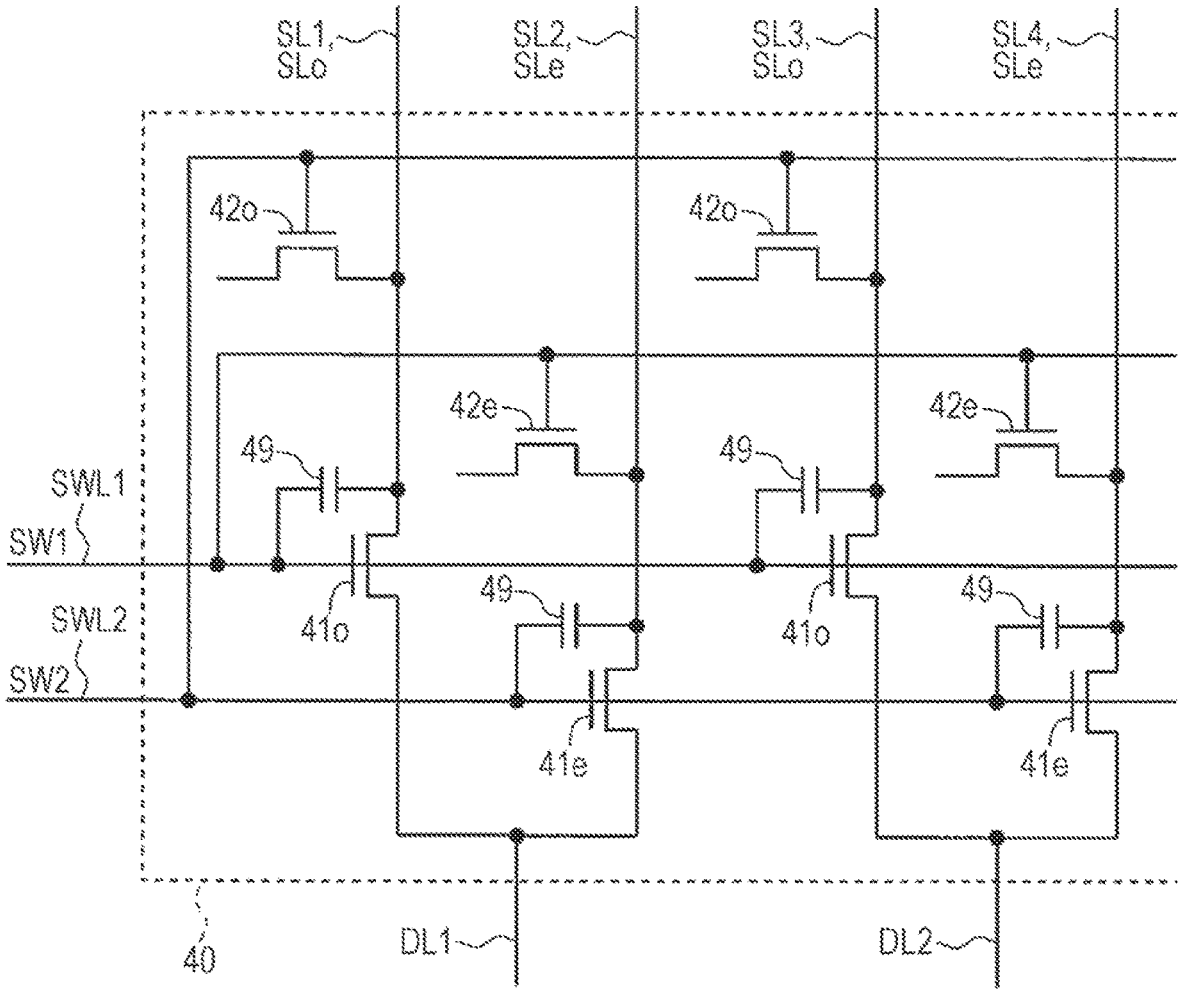
FIG. 7 is a circuit diagram for explaining a configuration of a demultiplexer circuit in a third embodiment.

FIG. 7 is a circuit diagram for explaining a configuration of a demultiplexer circuit 40 in the present embodiment. As in the case of the first embodiment (see FIG. 1), the demultiplexer circuit 40 in the present embodiment, too, includes compensating transistors in addition to connection control transistors. That is, as in the case of the first embodiment, the demultiplexer circuit 40 includes connection control transistors 41*o*, connection control transistors 41*e*, compensating transistors 42*o*, and compensating transistors 42*e*. The connection control transistors are identical in configuration to those of the first embodiment. The compensating transistors are different in configuration from those of the first embodiment in terms of control signals that are supplied to the control terminals. In the present embodiment, each of the compensating transistor 42*o* has its control terminal supplied with a control signal SW2 for controlling the turning on and turning off of a corresponding one of the connection control transistors 41*e*, and each of the compensating transistors 42*e* has its control terminal supplied to a control signal SW1 for controlling the turning on and turning off of a corresponding one of the connection control transistors 41*o*. That is, when two source bus lines constituting a source bus line group are defined as a first source bus line and a second source bus line, a control signal that is supplied to the control terminal of a connection control transistor having a second conducting terminal connected to the first source bus line is supplied to the control terminal of a compensating transistor having a first conducting terminal connected to the second source bus line, and a control signal that is supplied to the control terminal of a connection control transistor having a second conducting terminal connected to the second source bus line is supplied to the control terminal of a compensating transistor having a first conducting terminal connected to the first source bus line.

3.2 Driving Method

Next, a driving method in the present embodiment is described with reference to a timing chart shown in FIG. 8. Note, however, that since the driving method in the present embodiment is substantially the same as the driving method in the second embodiment (see FIG. 6), the following describes points of difference from the second embodiment. Note that time points t20 to t27 of FIG. 8 correspond to the time points t10 to t17 of FIG. 6.

In the second embodiment, at the same timing as the control signal SW1 changes from the high level to the low level, the control signal SW1B, which is supplied to the control terminal of the compensating transistor 42*o*, changes from the low level to the high level. Further, in the second embodiment, at the same timing as the control signal SW2 changes from the high level to the low level, the control signal SW2B, which is supplied to the control terminal of the compensating transistor 42*e*, changes from the low level to the high level. On the other hand, in the present embodiment, which adopts the configuration shown in FIG. 7, the level of a control signal that is supplied to the control terminal of the compensating transistor 42*o* does not change at the same timing as the control signal SW1 changes from the high level to the low level, and the level of a control signal that is supplied to the control terminal of the compensating transistor 42*e* does not change at the same timing as the control signal SW2 changes from the high level to the low level.

Figure 8:
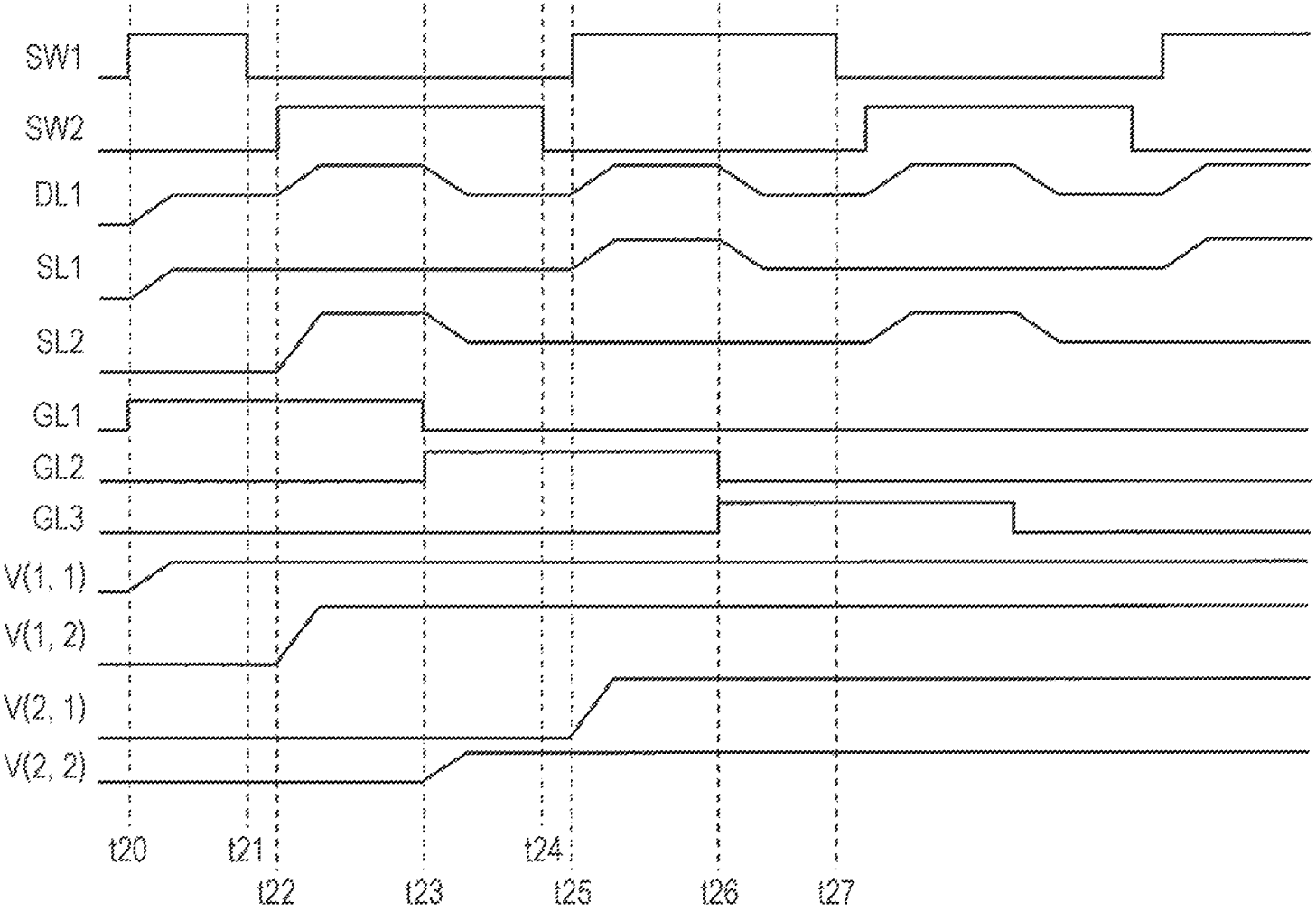
FIG. 8 is a timing chart for explaining a driving method in the third embodiment.
Figure 9:
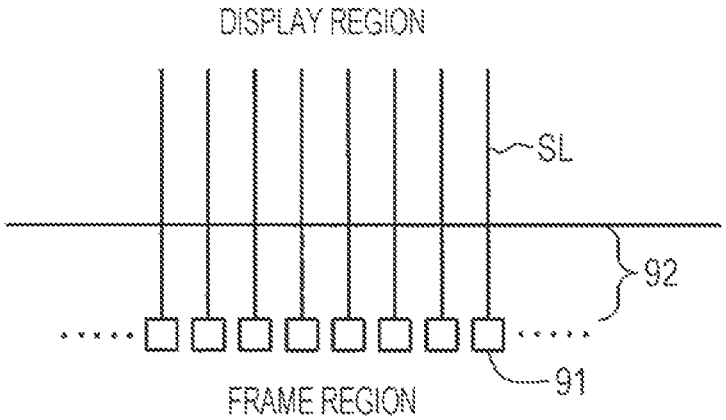
FIG. 9 is a diagram for explaining a frame region.
Figure 10:
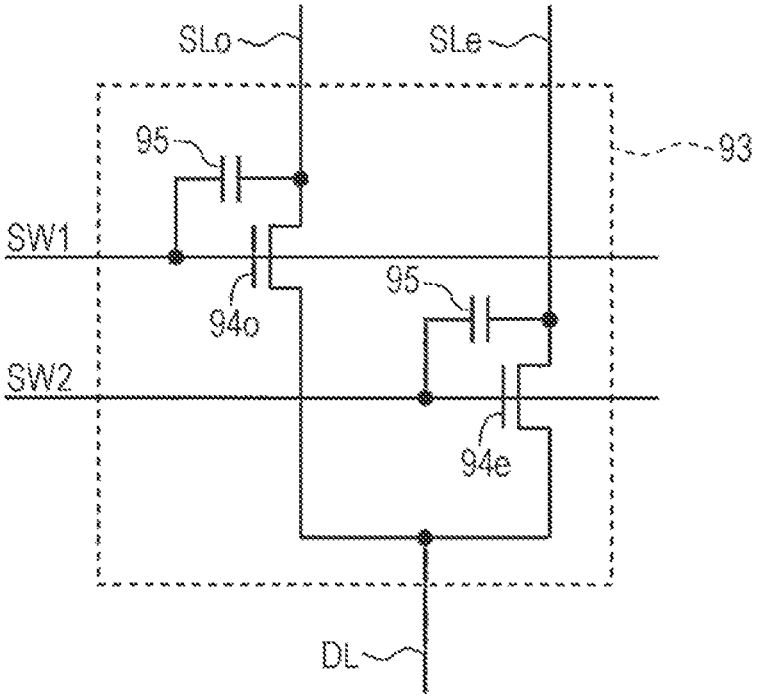
FIG. 10 is a circuit diagram for explaining a configuration of a conventional demultiplexer circuit.
Figure 11:
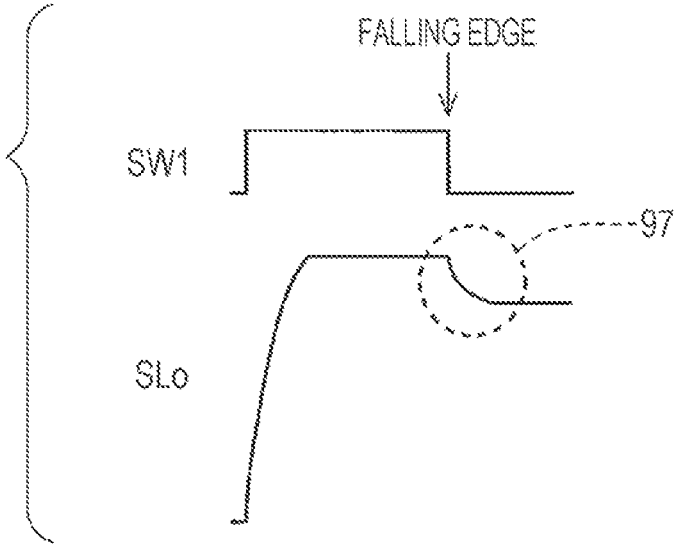
FIG. 11 is a diagram for explaining a reduction in display quality in a case where an SSD scheme is adopted in a conventional example.

As shown in FIG. 8, after the control signal SW1 has changed from the high level to the low level at the time point t21, the control signal SW2 changes from the low level to the high level at the time point t22. That is, after the connection control transistor 410 has changed from an on state to an off state due to the change of the control signal SW1 from the high level to the low level at the time point t21, the time point t22 comes, and at the time point t22, the control signal SW2, which is supplied to the control terminal of the compensating transistor 42*o*, changes from the low level to the high level. Accordingly, while a drop in potential of the source bus line SL1 occurs at the time point t21, a boost in potential of the source bus line SL1 occurs at the time point t22. Further, since the potential of the gate bus line GL1 is maintained at the high level during a period from the time point t20 to the time point t23, writing to the pixel forming sections PIX in the first row continues until the time point t23. Thus, the drop in potential of the source bus line SL1 at the time point t21 and the boost in potential of the source bus line SL1 at the time point t22 get balanced out, so that a desired voltage is written to the liquid crystal capacitor 14 in the pixel forming section PIX(1,1).

Similarly, after the control signal SW2 has changed from the high level to the low level at the time point t24, the control signal SW1 changes from the low level to the high level at the time point t25 (see FIG. 8). That is, after the connection control transistor 41*e* has changed from an on state to an off state due to the change of the control signal SW2 from the high level to the low level at the time point t24, the time point t25 comes, and at the time point t25, the control signal SW1, which is supplied to the control terminal of the compensating transistor 42*e*, changes from the low level to the high level. Accordingly, while a drop in potential of the source bus line SL2 occurs at the time point t24, a boost in potential of the source bus line SL2 occurs at the time point t25. Further, since the potential of the gate bus line GL2 is maintained at the high level during a period from the time point t23 to the time point t26, writing to the pixel forming sections PIX in the second row continues until the time point t26. Thus, the drop in potential of the source bus line SL2 at the time point t24 and the boost in potential of the source bus line SL2 at the time point t25 get balanced out, so that a desired voltage is written to the liquid crystal capacitor 14 in the pixel forming section PIX(2,2).

As described above, in the present embodiment, at a timing from a point of time where a connection control transistor changed from an on state to an off state due to a change from the high level to the low level of a control signal that is supplied to the control terminal of the connection control transistor to a point of time of switching between horizontal scanning periods, a control signal that is supplied to the control terminal of a compensating transistor corresponding to the connection control transistor changes from the low level to the high level.

3.3 Effects

In the present embodiment, too, as in the case of the first embodiment, regarding a liquid crystal display device that adopts an SSD scheme, a reduction in display quality attributed to a drop in potential of a source bus line SL is suppressed without a reduction in the degree of freedom of design. Further, since the SSD control signals SW are lower in frequency as in the case of the second embodiment, an effect of reducing power consumption can be brought about. Furthermore, since only two control signals (namely the control signal SW1 and the control signal SW2) are used as the SSD control signals SW, the number of signal lines can be made smaller than it is in the first embodiment. This makes it possible to achieve a narrower frame region, bringing about improvement in the degree of freedom of design.

4. Other

Although the present disclosure has been described in detail above, the foregoing description is not restrictive but illustrative in all aspects. It is understood that a large number of other alterations or modifications can be devised without departing from the scope of the disclosure. For example, although each embodiment has been described by taking a liquid crystal display device as an example, the present disclosure is also applicable to another display device such as an organic EL display device.

The present disclosure contains subject matter related to that disclosed in U.S. Provisional Patent Application No. 62/968,964 filed in the United States Patent Office on Jan. 31, 2020, the entire contents of which are hereby incorporated by reference.

What is claimed is:

1. A display device including a plurality of video signal lines, a plurality of scanning signal lines that intersect the plurality of video signal lines, a plurality of pixel forming sections disposed in correspondence with intersections of the plurality of video signal lines and the plurality of scanning signal lines, respectively, and a scanning signal line driving circuit that drives the plurality of scanning signal lines, the display device comprising:

a video signal line driving circuit that outputs video signals in a time-division manner during each horizontal scanning period to data output lines corresponding separately to each video signal line group obtained by grouping the plurality of video signal lines with K (where K is an integer of 2 or larger) video signal lines as one set; and a connection switching circuit that changes from connecting a data output line corresponding to a video signal line group to one of K video signal lines constituting the video signal line group to connecting the data output line to another one of the K video signal lines in a time-division manner during each horizontal scanning period, wherein the connection switching circuit includes a connection control transistor and a compensating transistor for each video signal line of interest, the video signal line of interest being an arbitrary video signal line, the connection control transistor including a control terminal, a first conducting terminal connected to a corresponding data output line, and a second conducting terminal connected to the video signal line of interest, the compensating transistor including a control terminal, a first conducting terminal connected to the video signal line of interest, and a second conducting terminal that is maintained in a floating state.

2. The display device according to claim 1, wherein at the same timing as the connection control transistor changes from an on state to an off state due to a change from a first level to a second level of a control signal that is supplied to the control terminal of the connection control transistor, a control signal that is supplied to the control terminal of the compensating transistor changes from the second level to the first level.

3. The display device according to claim 2, wherein when the control signal that is supplied to the control terminal of the connection control transistor is at the first level, the control signal that is supplied to the control terminal of the compensating transistor is at the second level, and when the control signal that is supplied to the control terminal of the connection control transistor is at the second level, the control signal that is supplied to the control terminal of the compensating transistor is at the first level.

4. The display device according to claim 3, wherein K is 2, and when two video signal lines constituting a video signal line group are defined as a first video signal line and a second video signal line, a connection control transistor having a second conducting terminal connected to the first video signal line is maintained in an on state during at least some period of a first half of each horizontal scanning period, and a connection control transistor having a second conducting terminal connected to the second video signal line is maintained in an on state during at least some period of a second half of each horizontal scanning period.

5. The display device according to claim 3, wherein K is 2, and when two video signal lines constituting a video signal line group are defined as a first video signal line and a second video signal line, a connection control transistor having a second conducting terminal connected to the first video signal line is maintained in an on state over a period from a second half of an even-numbered horizontal scanning period to a first half of an odd-numbered horizontal scanning period, and a connection control transistor having a second conducting terminal connected to the second video signal line is maintained in an on state over a period from a second half of an odd-numbered horizontal scanning period to a first half of an even-numbered horizontal scanning period.

6. The display device according to claim 1, wherein K is 2, and when two video signal lines constituting a video signal line group are defined as a first video signal line and a second video signal line, a control signal that is supplied to the control terminal of a connection control transistor having a second conducting terminal connected to the first video signal line is supplied to the control terminal of a compensating transistor having a first conducting terminal connected to the second video signal line, and a control signal that is supplied to the control terminal of a connection control transistor having a second conducting terminal connected to the second video signal line is supplied to the control terminal of a compensating transistor having a first conducting terminal connected to the first video signal line.

7. The display device according to claim 6, wherein at a timing from a point of time where the connection control transistor changed from an on state to an off state due to a change from the first level to the second level of a control signal that is supplied to the control terminal of the connection control transistor to a point of time of switching between horizontal scanning periods, a control signal that is supplied to the control terminal of the compensating transistor changes from the second level to the first level.

* * * * *